United States Patent [19]

Miller et al.

[11] Patent Number: 4,486,294

[45] **Date of Patent: * Dec. 4, 1984**

[54] PROCESS FOR SEPARATING HIGH VISCOSITY BITUMEN FROM TAR SANDS

[75] Inventors: Jan D. Miller; Manoranjan Misra, both of Salt Lake City, Utah

[73] Assignee: University of Utah, Salt Lake City, Utah

[ * ] Notice: The portion of the term of this patent subsequent to Oct. 18, 2000 has been disclaimed.

[21] Appl. No.: 543,193

[22] Filed: Oct. 17, 1983

Related U.S. Application Data

[63] Continuation-in-part of Ser. No. 194,515, Oct. 6, 1980, Pat. No. 4,410,417.

[51] Int. Cl.[3] ..... C10G 1/00; C10G 1/04

[52] U.S. Cl. ..... 208/11 LE; 209/5; 196/14.52

[58] Field of Search ..... 208/11 LE; 196/14.52

[56] References Cited

U.S. PATENT DOCUMENTS

| | | | |
|---|---|---|---|
| 792,031 | 6/1905 | Herrick et al. . | |
| 1,497,607 | 6/1924 | Streppel . | |
| 1,514,113 | 11/1924 | Trumble . | |
| 1,820,917 | 9/1931 | Langford et al. . | |
| 2,453,060 | 11/1948 | Bauer et al. | 208/11 LE |
| 2,453,060 | 11/1948 | Bauer et al. | 196/14 |
| 2,453,633 | 11/1948 | Logan | 208/11 LE |
| 2,471,119 | 5/1949 | Peck et al. | 202/6 |
| 2,579,398 | 12/1951 | Roetheli | 48/202 |
| 2,871,180 | 1/1959 | Lowman, Jr. et al. | 208/11 |
| 2,903,407 | 9/1959 | Fischer et al. | 208/11 |
| 2,908,617 | 10/1959 | Murphree | 202/14 |
| 2,916,346 | 12/1959 | Jalkanen | 8/156 |
| 2,927,007 | 3/1960 | Kaether | 23/270 |
| 2,965,557 | 12/1960 | Price | 208/11 |
| 3,041,267 | 6/1962 | Frame et al. | 208/11 |
| 3,159,562 | 12/1964 | Bichard et al. | 208/11 |
| 3,161,581 | 12/1964 | Tiedje et al. | 208/11 |
| 3,172,609 | 3/1965 | Olsen et al. | 241/69 |
| 3,261,775 | 7/1966 | Blaser | 208/85 |
| 3,271,293 | 9/1966 | Clark | 196/14.52 |
| 3,320,152 | 5/1967 | Nathan et al. | 208/11 |
| 3,352,500 | 11/1967 | Molls et al. | 241/74 |
| 3,392,105 | 7/1968 | Poettmann et al. | 208/11 |
| 3,401,110 | 9/1968 | Floyd et al. | 208/11 |
| 3,466,240 | 9/1969 | Steinmetz | 208/11 |
| 3,518,181 | 6/1970 | Tse | 208/11 |
| 3,553,098 | 1/1971 | Claridge et al. | 208/11 |
| 3,553,099 | 1/1971 | Savage et al. | 208/11 |
| 3,556,980 | 1/1971 | Clark et al. | 208/11 |
| 3,560,371 | 2/1971 | Kaminsky | 208/11 |

(List continued on next page.)

FOREIGN PATENT DOCUMENTS

| | | | |
|---|---|---|---|
| 530920 | 9/1956 | Canada | 208/11 |
| 1675523 | 12/1963 | Canada | 208/11 LE |
| 883974 | 10/1971 | Canada | 183/3 |

OTHER PUBLICATIONS

J. E. Sepulveda and J. D. Miller, "Separation of Bitumen from Utah Tar Sands by a Hot Water Digestion-Flotation Technique," 30 *Mining Engineering,* 1311–1320, (1978).

M. Misra and J. D. Miller, "The Effect of Feed Source in the Hot Water Processing of Utah Tar Sand," 32 *Mining Engineering,* pp. 302 et seq., (1980).

R. J. Smith and J. D. Miller, "The Flotation Behavior of Digested Asphalt Ridge Tar Sands," *Mining Engineering,* 1719–1724, (1981).

*Primary Examiner*—Delbert E. Gantz
*Assistant Examiner*—Helane E. Maull
*Attorney, Agent, or Firm*—H. Ross Workman; Allen R. Jensen; Dale E. Hulse

[57] ABSTRACT

A novel process for separating high viscosity bitumen from tar sand. The process includes grinding the tar sand to obtain phase disengagement of the bitumen phase from the sand phase and thereafter using flotation techniques to obtain phase separation of the bitumen phase from the sand phase. Phase disengagement is assisted by using a suitable wetting agent such as sodium carbonate or sodium silicate during the grinding step, while the phase separation step is assisted by the inclusion of a promoter oil for the flotation step.

13 Claims, 7 Drawing Figures

U.S. PATENT DOCUMENTS

| | | | |
|---|---|---|---|
| 3,605,975 | 9/1971 | Brimhall | 196/14.52 |
| 3,640,476 | 2/1972 | Engels | 241/74 |
| 3,784,464 | 1/1974 | Kaminsky | 208/11 |
| 3,839,186 | 10/1974 | Berger | 208/8 |
| 3,844,490 | 10/1974 | Schold et al. | 241/74 |
| 3,847,789 | 11/1974 | Cymbalisty | 208/11 |
| 3,856,474 | 12/1974 | Pittman et al. | 23/267 |
| 3,867,110 | 2/1975 | Schora et al. | 48/210 |
| 3,875,046 | 4/1975 | Rosenbloom | 208/11 |
| 3,893,907 | 7/1975 | Canevari | 208/11 |
| 4,029,568 | 6/1977 | Pittman et al. | 208/11 |
| 4,067,796 | 1/1978 | Alford et al. | 208/11 LE |
| 4,094,767 | 6/1978 | Gifford | 208/11 |
| 4,096,057 | 6/1978 | Porritt et al. | 208/11 |
| 4,110,195 | 8/1978 | Harding | 196/14.52 |
| 4,120,776 | 10/1978 | Miller et al. | 208/11 |
| 4,161,442 | 7/1979 | Audeh et al. | 208/11 |
| 4,174,263 | 11/1979 | Veatch et al. | 208/11 LE |
| 4,201,656 | 5/1980 | Sanford | 208/11 |
| 4,250,017 | 2/1981 | Reale | 208/11 LE |
| 4,337,143 | 6/1982 | Hanson et al. | 208/11 |
| 4,361,476 | 11/1982 | Brewer | 208/11 LE |
| 4,409,090 | 10/1983 | Hanson et al. | 208/11 |
| 4,410,417 | 10/1983 | Miller et al. | 208/11 LE |
| 4,425,227 | 1/1984 | Smith | 209/5 |

PROCESS FOR SEPARATING HIGH VISCOSITY BITUMEN FROM TAR SANDS

BACKGROUND

1. The Field of the Invention

The present invention relates to the separation of bitumen from tar sands and, more particularly, to a process for separating bitumen from tar sands having a relatively high viscosity.

2. Related Applications

This application is a continuation-in-part application of my copending application Ser. No. 194,515, filed Oct. 6, 1980 now U.S. Pat. No. 4,410,417, entitled "Process For Separating High Viscosity Bitumen From Tar Sands."

3. The Prior Art

The term "tar sand" refers to a mixture of bitumen (tar) and sand. Alternate names for tar sands are "oil sands" and "bituminous sands," the latter term being more technically correct in that the sense of the term provides an adequate description. However, for convenience herein, the term "tar sand" will be used throughout. The bitumen of tar sand consists of a mixture of a variety of hydrocarbons and heterocyclic compounds and, if properly separated from the sand, may be upgraded to a synthetic crude oil suitable for use as a feedstock for the production of liquid motor fuels, heating oil, and/or petrochemicals.

Tar sand deposits occur throughout the world, often in the same geographical area as conventional petroleum deposits. About 65 percent of all of the known oil in the world is contained in tar sand deposits or in heavy oil deposits. Significantly large tar sand deposits have been identified and mapped in Canada, Venezuela, and the United States. The Canadian tar sands are one of the largest deposits in the world having an estimated recoverable potential of approximately 900 billion barrels and are currently being developed. About 90 to 95 percent of the mapped tar sand deposits of the United States are located within the state of Utah. The Utah tar sand deposits are estimated to include at least 25 billion barrels of oil. Although the Utah tar sand reserves appear small in comparison with the enormous potential of the Canadian tar sands, Utah tar sand reserves represent a significant energy resource when compared to the United States crude oil proven reserves (approximately 31.3 billion barrels) and with the United States crude oil production of almost 3.0 billion barrels during 1976.

Tar sands in Utah occur in 51 deposits generally along the eastern side of the state, although only six of these deposits are currently worthy of any practical consideration. Table I sets forth the estimated in-place bitumen in billions of barrels for each of these six major deposits. The bitumen content varies from deposit to deposit as well as within a given deposit and current information available indicates that Utah tar sand deposits average generally less than about 10 percent bitumen (by weight) although deposits have been found with a bitumen saturation up to about 17 percent bitumen (by weight).

TABLE I

Extent of Utah Tar Sand Deposits

| Deposit | Location | In-Place Bitumen (billion barrels) |
|---|---|---|
| Tar Sand Triangle | SE, Utah | 12.5–16.0 |
| P. R. Spring | NE, Utah | 4.0–4.5 |

TABLE I-continued

Extent of Utah Tar Sand Deposits

| Deposit | Location | In-Place Bitumen (billion barrels) |
|---|---|---|
| Sunnyside | NE, Utah | 3.5–4.0 |
| Circle Cliffs | SE, Utah | 1.3 |
| Hill Creek | NE, Utah | 1.2 |
| Asphalt Ridge | NE, Utah | 1.0 |

Various processing strategies have been explored over the past approximately 50 years. However, because of the significant differences in the physical and chemical nature of Utah tar sands as compared to Canadian tar sands, and because of the great differences in climatic conditions between the two locations, the technology developed for the Canadian tar sands cannot be applied to Utah tar sands directly. One process that has been developed specifically for Utah tar sands is set forth in U.S. Pat. No. 4,120,776. This technology is classified under the general heading of a hot water process wherein a hot, aqueous solution having a controlled pH range is used to displace the bitumen from the sand.

An important feature of the Utah tar sands is their substantially greater bitumen viscosity in comparison to the bitumen viscosity of Canadian tar sands. For example, the viscosity of bitumen from the Asphalt Ridge deposit is about one order of magnitude greater than the viscosity of Canadian bitumen while, correspondingly, tar sand samples from the Sunnyside deposit have a bitumen viscosity that is about two orders of magnitude greater than the viscosity of the Canadian bitumen. Further, the viscosity of bitumen from a Tar Sand Triangle sample is well over four orders of magnitude greater than the viscosity of bitumen from the Canadian deposits.

An Arrhenius-type graph illustrating the viscosities of bitumen from various tar sand deposits at various temperatures may be seen in FIG. 7. Moreover, an additional discussion on the differences in the viscosity of the bitumen in various tar sands may be found in J. D. Miller et al., "Hot Water Process Development For Utah Tar Sands," 6 Fuel Processing Technology 27-59 (1982), which article is incorporated herein by reference.

While relatively good separation of the bitumen from the tar sand has been obtained using variations in the hot water separation processes, any hot water processing strategy requires substantial energy input. For example and with particular reference to FIG. 6, it is calculated that the required energy input for digestion in the hot water process (operating at 95° C. and obtaining about 90 percent bitumen recovery) requires at least 45 kilowatt hours of energy per ton of tar sand processed. In the ambient temperature process of the present invention, the energy input for size reduction is substantially lower, requiring less than 13 kilowatt hours per ton of tar sand processed to achieve the same level of recovery.

In view of the foregoing, it would be a significant advancement in the art to provide an ambient temperature, physical separation process for the recovery of bitumen from Utah tar sands without reverting to a hot water process. It would also be an advancement in the art to provide a novel process for the recovery of high viscosity bitumen from Utah tar sand deposits by a simple mechanical process for phase disengagement followed by flotation for phase separation and bitumen concentration. Such a novel process is disclosed and claimed herein.

BRIEF SUMMARY AND OBJECTS OF THE INVENTION

The present invention relates to a novel process for obtaining bitumen from high viscosity tar sands whereby phase disengagement is accomplished by mechanical size reduction. Phase disengagement is followed by flotation to achieve phase separation. Advantageously, because of the high viscosity of bitumen found in the Sunnyside deposit and the Tar Sand Triangle deposit, it is possible to achieve phase disengagement by conventional size reduction techniques at ambient temperature. Improvements in the phase disengagement are obtained using a controlled amount of wetting agent such as sodium carbonate or sodium silicate. The addition of a suitable promoter such as fuel oil in limited quantities has been found to greatly assist phase separation by flotation.

It is, therefore, a primary object of this invention to provide improvements in processing tar sands for the recovery of bitumen.

Another object of this invention is to provide a process for obtaining a bitumen concentrate from a high viscosity tar sand such as found in the Sunnyside deposit and the Tar Sand Triangle deposit of Utah tar sands.

Another object of this invention is to provide an improved process for recovering bitumen from tar sand at ambient temperatures.

Another object of this invention is to provide a novel process for recovering high viscosity bitumen from tar sands wherein bitumen phase disengagement is assisted with a wetting agent and bitumen separation by flotation is assisted through the use of a suitable promoter.

Another object of this invention is to provide a process for recovering high viscosity bitumen from tar sands at a substantially decreased level of energy requirement.

Another object of this invention is to provide a process for recovering bitumen from tar sands wherein ultimate water recovery for recycle is enhanced as compared to prior art, hot-water processes.

These and other objects and features of the present invention will become more fully apparent from the following description and appended claims taken in conjunction with the accompanying drawing.

DETAILED DESCRIPTION OF THE PREFERRED EMBODIMENTS

Figure 1:
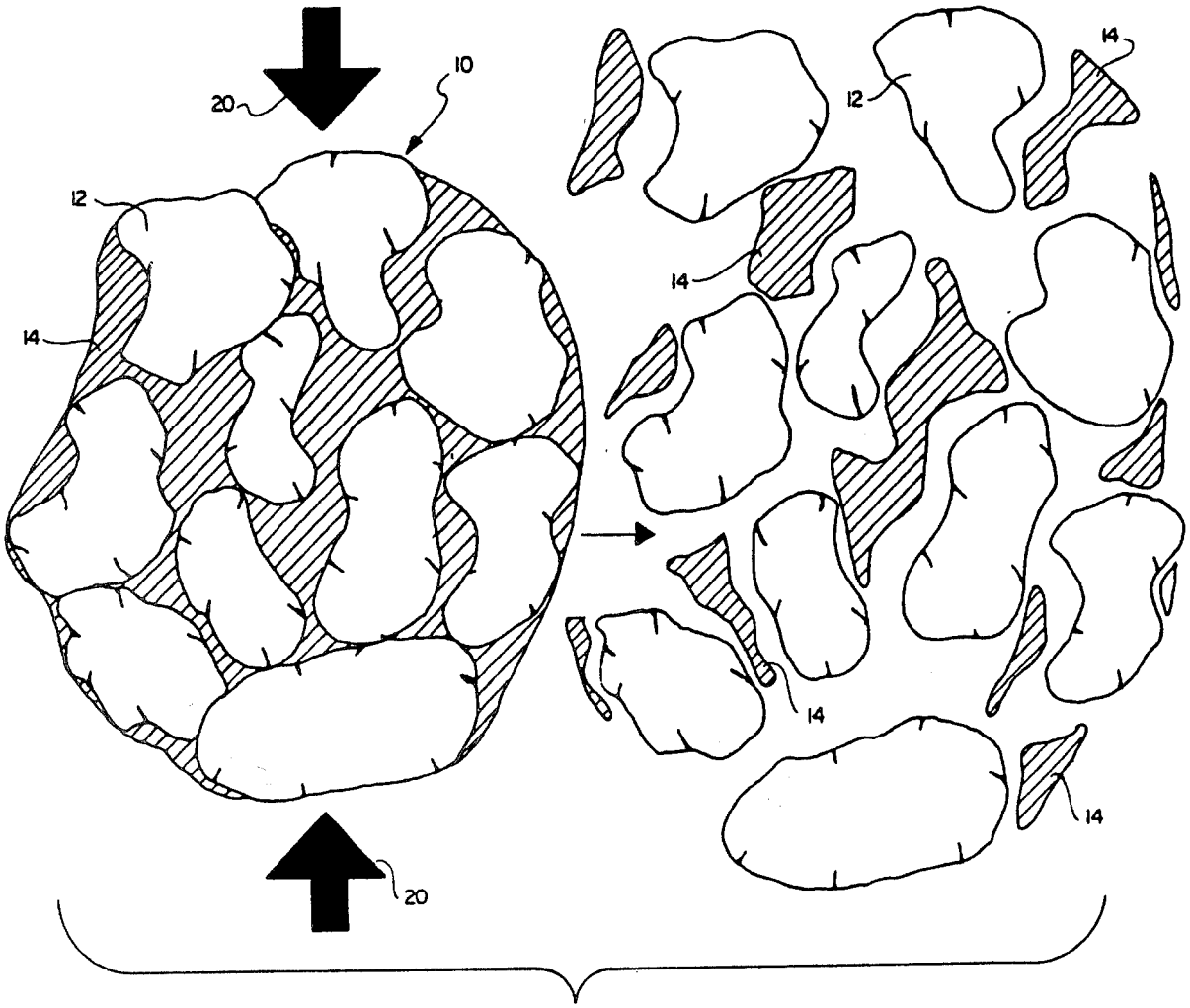
FIG. 1 is a schematic illustration of a high viscosity tar sand sample subjected to grinding to achieve phase disengagement of the bitumen from the tar sand.

The invention is best understood by reference to the drawing wherein like parts are designated with like numerals throughout.

Referring now more particularly to FIG. 1, a schematic representation of a high viscosity tar sand sample is illustrated generally at 10 and includes a plurality of sand particles 12 embedded and otherwise bonded together by a matrix of bitumen 14. As set forth hereinbefore, tar sand 10 is obtained from a deposit having a suitably high viscosity such as can be obtained from the Sunnyside deposit and the Tar Sand Triangle deposit of Utah tar sand. Importantly, bitumen 14 from these deposits has a viscosity at least an order of magnitude greater than other deposits such as the Asphalt Ridge deposit.

Generally, for purposes of the present invention, it has been found that the bitumen in the tar sand to be treated must have a viscosity greater than about 50 poise at 90° C. if the mechanical size reduction and phase disengagement step is to be conducted no lower than at ambient temperature. As will be readily appreciated, any tar sand, regardless of its initial bitumen viscosity, may be treated by the process of the present invention if the bitumen can be rendered sufficiently viscous, e.g., by lowering the temperature of the tar sand or by other means.

Tar sand 10 is suitably crushed or ground by conventional size reduction techniques (crushing and grinding), indicated generally by heavy arrows 20, to accomplish the phase disengagement between sand 12 and bitumen 14. This phase disengagement is illustrated schematically at the right in FIG. 1. Lower viscosity samples of tar sand 10 (such as from the Asphalt Ridge deposit of Utah tar sand) were subjected to grinding 20 and failure resulted since no suitable phase disengagement between sand particles 12 and bitumen 14 was obtained. While this invention is directed to a process for separating high viscosity bitumen from tar sand such as found in the Sunnyside deposit and the Tar Sand Triangle deposit, the process is also applicable to tar sands in which the bitumen has been treated to impart the necessary viscosity characteristics similar to the above-mentioned bitumen.

Although conventional grinding techniques are utilized in the process of this invention, care is taken to preclude excessive size reduction. For example, and with specific reference to FIG. 3, it is shown that as the percentage of sand particles smaller than about 100 microns increases, the bitumen recovery increases dramatically, reaches a maximum, and then decreases slightly. The coefficient of separation responds in similar fashion. While the precise reason for this modest reduction in the efficiency of separation at finer particle sizes is not clearly understood, it is believed that excessive grinding of sand particles 12 results in a fine sand which tends to float along with the bitumen during the flotation process. Furthermore, for reasons not clearly understood, excessive size reduction causes a portion of bitumen 14 to become agglomerated so that a portion of the bitumen 14 reports to the sand discharge with a corresponding lowering of recovery and the coefficient of separation.

Figure 2:
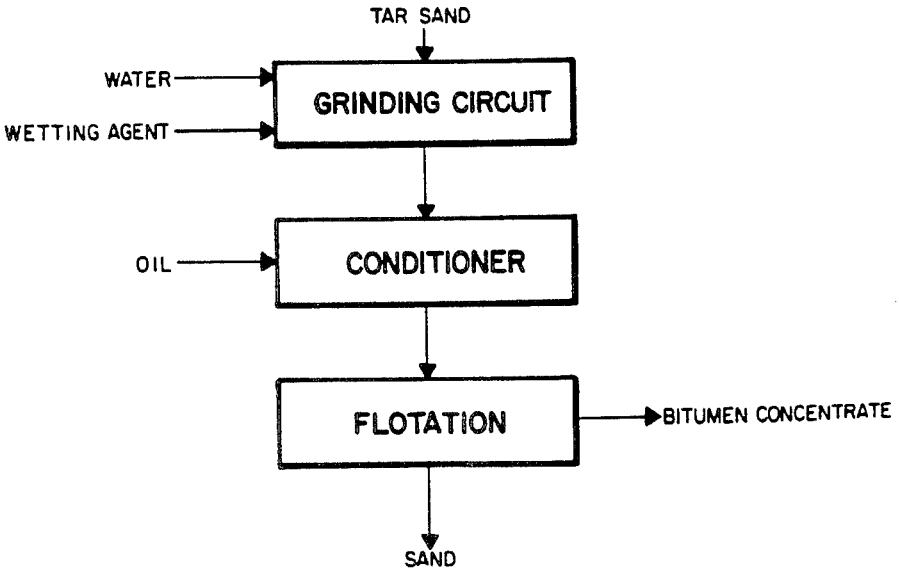
FIG. 2 is a schematic flow process for the novel process of this invention.

With reference also to FIG. 2, a schematic illustration of the conventional process is shown herein wherein tar sand 10 (FIG. 1) is introduced into the conventional grinding circuit along with water and a suitable wetting agent. Preferably, the addition of a suitable wetting agent such as sodium carbonate or sodium silicate to raise the pH to within a range between about 7.0 and about 9.0 or, in other words, to a moderately alkaline pH, provides a substantial improvement in the coefficient of separation. (Typically, this requires from about 2 to about 10 pounds of sodium carbonate or sodium silicate per ton of tar sand. However, it will be appreciated that the exact amount of wetting agent needed to bring the pH within the range of about 7.0–9.0 will depend upon such factors as the initial pH of the tar sand.)

Figure 5:
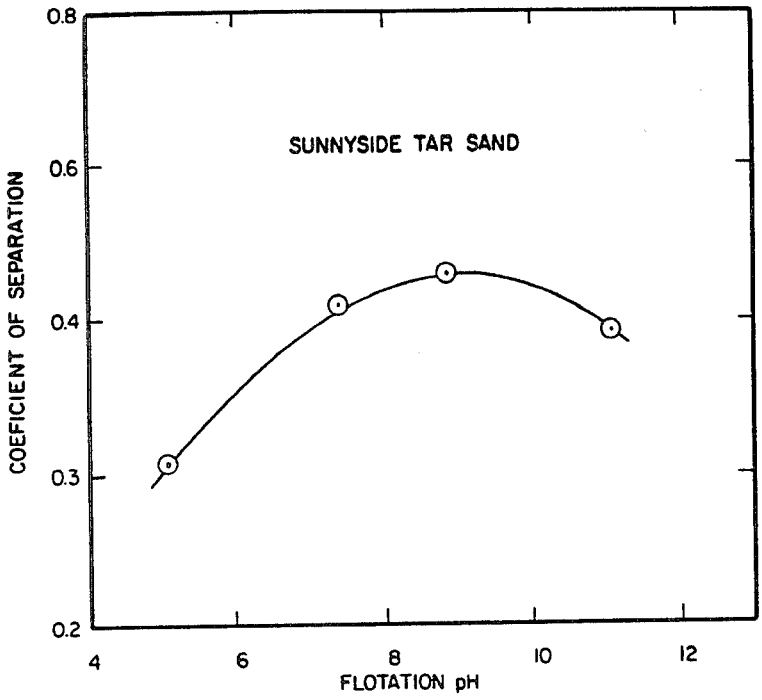
FIG. 5 is a chart comparing the coefficient of separation with the pH of the system.
Figure 6:
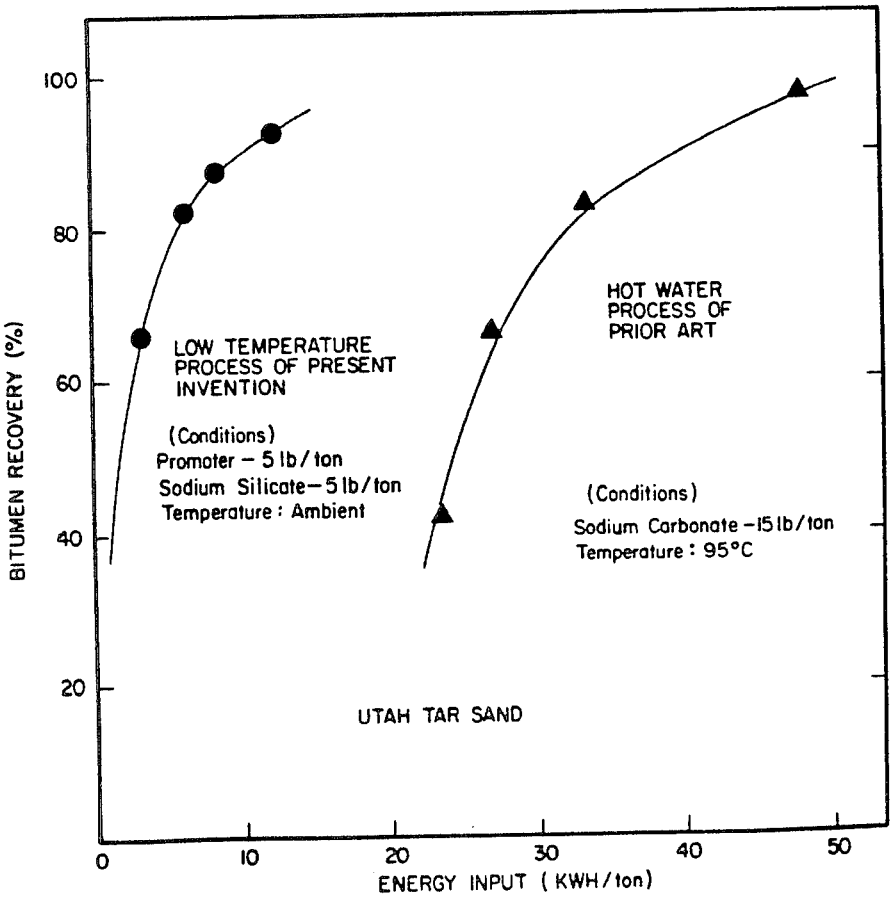
FIG. 6 is a chart showing bitumen recovery versus energy input for the process of the present invention in comparison with the prior art, hot water process.
Figure 7:
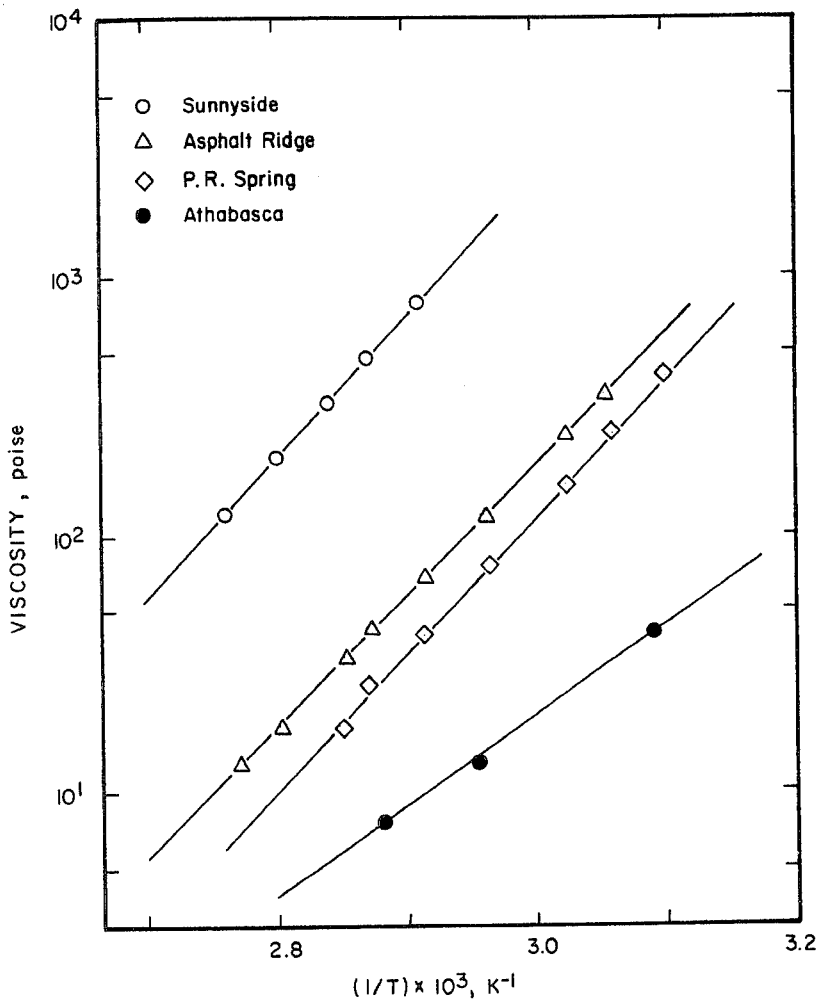
FIG. 7 is an Arrhenius-type plot illustrating the viscosities of bitumen from various tar sand deposits at various temperatures.

With particular reference to FIG. 5, the coefficient of separation is compared with the flotation pH to further illustrate the foregoing. In particular, at low pH conditions there is a markedly lower coefficient of separation while, correspondingly, at higher pH ranges above about pH 9 there is a corresponding decrease in the coefficient of separation.

It is believed that sodium silicate acts as a dispersant, and to some extent, to depress flotation of the sand particles. Further, sodium silicate acts to remove fine slime coatings from the bitumen particles, resulting in increased bitumen recovery and grade.

A sample of Sunnyside tar sand was crushed to −4 mesh and wet ground in a ball mill at 70% by weight solids for 30 minutes. In one experiment, 5 pounds of sodium silicate per ton of tar sand was added to the ball mill, and in the other experiment, no sodium silicate was added. In each experiment, the ground tar sand was introduced into a Galigher flotation cell (2.5 liter capacity) and flotation was conducted at 10% solids and at an air flow rate of 9 liters per minute. The results of these flotation experiments are given in Table II below. Note that in these experiments no frother or promoter was used.

TABLE II

Effect of Sodium Silicate in the Separation of High Viscosity Bitumen from Sunnyside Tar Sand

| Sodium Silicate Addition (lb/ton) | Grade Bitumen (%) | Recovery Bitumen (%) |
|---|---|---|
| None | 16.7 | 82.4 |
| 5 | 25.0 | 91.5 |

As seen from Table II above, a relatively small amount of sodium silicate added during the grinding step was found to significantly increase both the recovery and grade the of bitumen.

Referring again to FIG. 2, the finely divided tar sand, water and wetting agent slurry passes from the grinding circuit to the conditioner where a promoter is suitably dispersed with the tar sand/water/wetting agent slurry. The promoter is in the form of an oil and combines with bitumen 14 (see FIG. 1) to further increase the hydrophobicity of bitumen 14. A suitable dispersing agent such as sodium silicate may be added along with the promoter to assist in wetting and dispersing the sand suspension.

Figure 4:
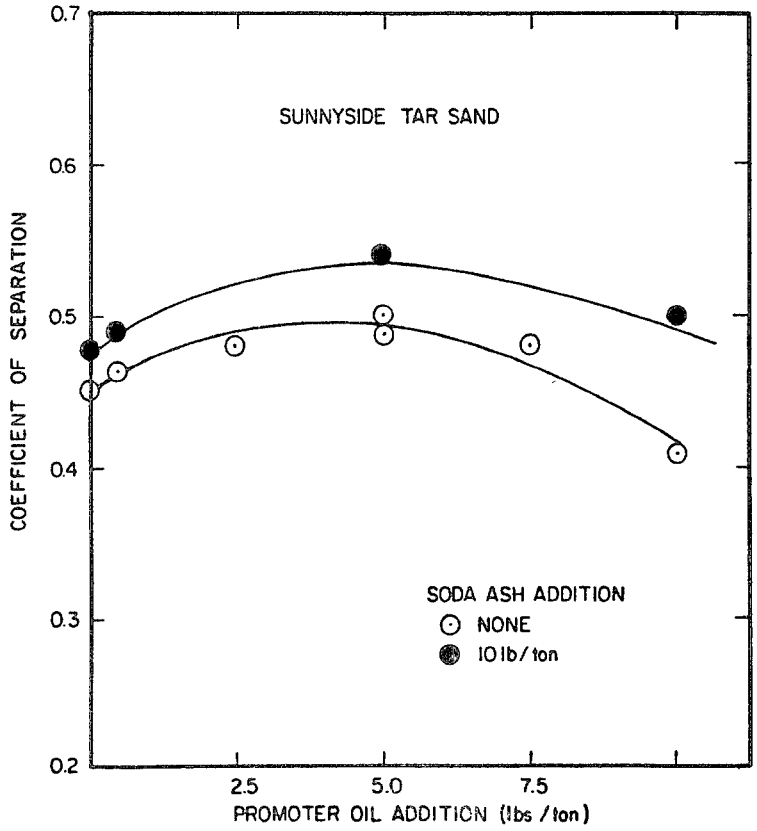
FIG. 4 is a chart comparing the coefficient of separation for various additions of promoter with and without the addition of sodium carbonate wetting agent.

Referring particularly to FIG. 4, a comparision is made between the coefficient of separation and the amount of promoter added in the conditioner (FIG. 2) per ton of incoming tar sand. It will be noted that excessive additions of promoter do not correspondingly improve the coefficient of separation but degrade the same. It is believed that excessive promoter or excessive conditioning results in an emulsification or dispersion of surface bitumen layers resulting in an increased loss of the dispersed bitumen in the flotation process. Additionally, it has been found that excessive conditioning in the conditioner also provides sufficient time for the promoter oil to act to remove the softened bitumen surface layers. This dispersed bitumen does not report to the bitumen concentrate. The foregoing combination of the addition of promoter in the conditioner in addition to the inclusion of soda ash (sodium carbonate, 10 pounds/ton) is shown in FIG. 4. It will be noted that excessive amounts of promoter (with or without soda ash) results in a decreased coefficient of separation, as set forth hereinbefore.

The promoter used herein is a neutral, molecular oil such as fuel oil, kerosene, or the like. While it is not expected to be recovered separately, most of the promoter is ultimately recovered in the bitument concentrate. In particular, it was found that approximately 90 percent of the bitumen was recovered in the concentrate using the promoter vs. about 8 percent without promoter. Correspondingly, approximately 90 percent of the promoter was recovered with the bitumen concentrate.

It should be noted that, unlike the prior art, hotwater processes, phase separation is achieved by a conventional flotation technique. That is, the flotation step of the present invention involves the attachment of air bubbles to the hydrophobic surface of the bitumen particles 14 (FIG. 1). By way of comparison, bitumen in the hot-water separation process is hydrophilic so that the modified flotation technique involves entrapment of air bubbles in the bitumen phase.

Figure 3:
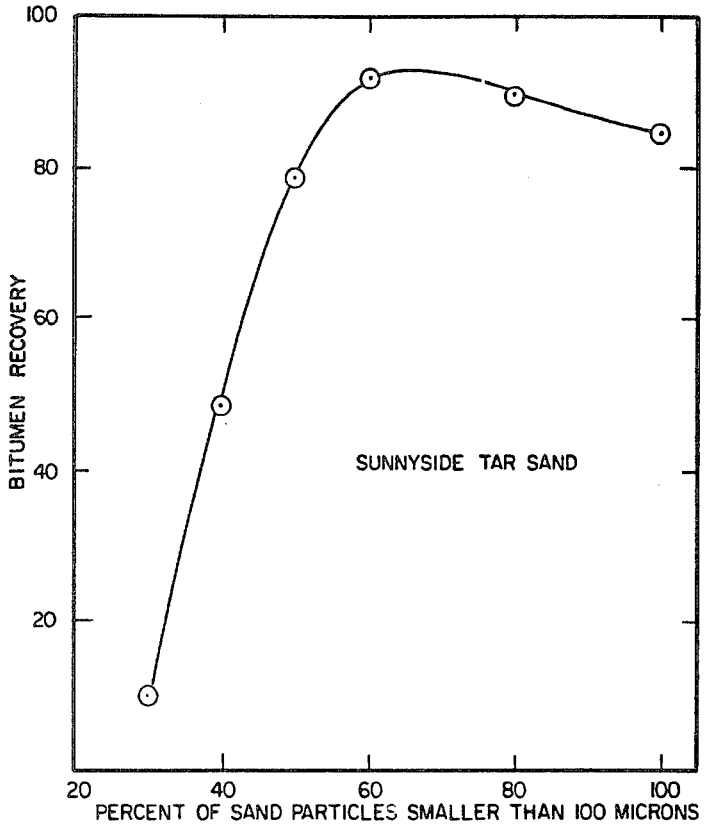
FIG. 3 is a chart comparing bitumen recovery with the sand particle size of the ground tar sand.

In one experimental procedure, tar sand from the Sunnyside deposit was introduced into the grinding circuit in the amount of 70 percent (by weight) tar sand with the addition of soda ash (sodium carbonate, $Na_2CO_3$, 10 pounds per ton of tar sand) with the balance consisting of water. The tar sand in the grinding circuit was ground by conventional techniques to a particle size wherein about 60 percent of the sand was less than about 100 microns in size. The recovery as compared to the percentage of sand particles smaller than about 100 microns is best illustrated in FIG. 3 as discussed hereinbefore.

Passing to the conditioner, a 20 percent (by weight) mixture of ground tar sand and water was introduced into the conditioner, and promoter in the form of fuel oil was added in the amount of 5 pounds per ton of tar sand. A suitable dispersant (sodium silicate) in the amount of 5 pounds per ton was also added to the conditioner. After being suitably conditioned (in this case, one minute), the mixture was passed to the flotation cell. Phase separation was achieved to produce a bitumen concentrate and a sand tailing. The mass balance for the bitumen concentrate and the sand tailing from the flotation separation is set forth in Table III. In particular, it will be noted that the amount of bitumen recovered is 93.84 weight percent although a substantial quantity of sand is carried over with the bitumen concentrate. However, it will be noted that the sand tailing is relatively clean, containing about one percent by weight bitumen thereby indicating the very high percentage of bitumen recovered in the bitumen concentrate. The most significant feature of the invention is that about 60 weight percent of the sand in the feed is rejected by this ambient temperature, single-stage process.

TABLE III

Mass Balances for Recovery of Bitumen from Sunnyside Tar Sand by an Ambient Temperature Physical Separation Process

| Product | Weight | Grade % Bitumen | Grade % Sand | Recovery % Bitumen | Recovery % Sand |
|---|---|---|---|---|---|
| With Wetting Agent | | | | | |
| Concentrate | 45.14 | 21.14 | 78.86 | 93.84 | 39.60 |
| Tailing | 54.86 | 1.15 | 98.85 | 6.16 | 60.40 |
| Feed | 100 | 10.17 | 89.83 | 100.00 | 100.00 |
| | | Coefficient of Separation = .54 | | | |
| Without Wetting Agent | | | | | |
| Concentrate | 46.77 | 20.25 | 79.75 | 92.21 | 41.57 |
| Tailing | 53.23 | 1.51 | 98.49 | 7.79 | 58.43 |
| Feed | 100 | 10.27 | 89.73 | 100 | 100 |
| | | Coefficient of Separation = .50 | | | |

Another experimental run was conducted using another tar sand sample from the Sunnyside deposit. However, carbonate was not added to the grinding stage. Instead, 70 weight percent tar sand was introduced into the grinding stage and was subjected to conventional size reduction techniques until 60 percent of the resulting particles passed 100 micron mesh. Fuel oil promoter on the ratio of 5 pounds per ton tar sand and a dispersant (sodium silicate) in the amount of 5 pounds per ton tar sand were added to the tar sand/water slurry in the conditioner. After being suitably conditioned, the resulting material was passed to the flotation cell on the basis of 20 weight percent tar sand. The results of the separation are set forth in Table III. Comparison is again made with FIG. 4 wherein it will be clearly shown that the addition of an appropriate amount of alkaline wetting agent has a significant effect on the coefficient of separation.

Advantageously, the bitumen concentrate obtained by the present invention contains no detectable amount of water, as determined by conventional analytical techniques, after drying for two hours under a heat lamp, whereas the bitumen concentrate produced by prior hot-water processes contains 20 percent water even after drying for eight hours under a heat lamp.

The present invention may be embodied in other specific forms without departing from its spirit or essential characteristics. The described embodiments are to be considered in all respects only as illustrative and not restrictive. The scope of the present invention is, therefore, indicated by the appended claims rather than by the foregoing description. All changes which come within the meaning and range of equivalency of the claims are to be embraced within their scope.

What is claimed and desired to be secured by United States Letters Patent is:

1. A process for recovering bitumen for tar sand comprising:
   obtaining a tar sand;
   grinding the tar sand so as to mechanically fracture the bitumen and thereby disengage bitumen particles from sand particles;
   mixing a wetting agent with the tar sand during ,he grinding step, the wetting agent further assisting in disengaging the bitumen particles from the sand particles;
   conditioning the bitumen particles with an oil to enhance the hydrophobicity of the bitumen particles; and
   separating the bitumen particles from the sand particles by flotation.

2. A process as defined in claim 1 wherein the grinding step comprises mechanically fracturing the bitumen while minimizing mechanical fracture of the sand particles such that the sand particles are of a particle size distribution within the range of about 55 percent to about 80 percent by weight passing 100 microns.

3. A process as defined in claim 1 wherein the wetting agent is sodium carbonate.

4. A process as defined in claim 1 wherein the wetting agent is sodium silicate.

5. A process as defined in claim 1 wherein the mixing step comprises mixing said wetting agent with the tar sand in an amount within the range of about 2 to about 10 pounds of wetting agent per ton of tar sand.

6. A process as defined in claim 1 wherein the conditioning step comprises mixing said oil with the tar sand in an amount within the range of about 2.5 to about 7.5 pounds of oil per ton of tar sand.

7. A process as defined in claim 1 wherein the grinding step is performed at ambient temperature.

8. A process for recovering high viscosity bitumen from tar sand comprising:
   obtaining a tar sand having a high viscosity bitumen, the viscosity of the bitumen being about 50 poise or greater at 90° C.;
   grinding the tar sand so as to mechanically fracture the bitumen and thereby disengage bitumen particles from sand particles, said mechanical fracture of the bitumen and said disengagement of the bitumen particles from the sand particles being facilitated by the high viscosity of the bitumen;
   mixing sodium silicate with the tar sand during the grinding step, the sodium silicate further assisting in disengaging the bitumen particles from the sand particles;
   conditioning the bitumen particles with an oil to enhance the hydrophobicity of the bitumen particles; and
   separating the bitumen particles from the sand particles by flotation.

9. A process as defined in claim 8 wherein the grinding step comprises mechanically fracturing the bitumen while minimizing mechanical fracture of the sand particles such that the sand particles are of a particle size distribution within the range of about 55 percent to about 80 percent by weight passing 100 microns.

10. A process as defined in claim 8 wherein the mixing step comprises mixing said sodium silicate with the tar sand in an amount within the range of about 2 to about 10 pounds of sodium silicate per ton of tar sand.

11. A process as defined in claim 8 wherein the conditioning step comprises mixing said oil with the tar sand in an amount within the range of about 2.5 to about 7.5 pounds of oil per ton of tar sand.

12. A process as defined in claim 8 wherein the grinding step is performed at ambient temperature.

13. A process for separating high viscosity bitumen from tar sand comprising:
   obtaining a tar sand having a high viscosity bitumen, the viscosity of the bitumen being greater than about 50 poise at 90° C.;
   grinding the tar sand in the presence of water and sodium silicate in an amount within the range of about 2 to about 10 pounds of sodium silicate per ton of tar sand so as to mechanically fracture the bitumen while minimizing mechanical fracture of the sand particles and thereby disengage bitumen particles from sand particles, said mechanical fracture of the bitumen and said disengagement of the bitumen particles from the sand particles being facilitated by the high viscosity of the bitumen, the sand particles being of a particle size distribution within the range of about 55 percent to about 80 percent by weight passing 100 microns;

conditioning the bitumen particles with an oil in an amount within the range of about 2.5 to about 7.5 pounds of oil per ton of tar sand; and floating the disengaged bitumen particles from the sand particles to obtain separation of the bitumen particles.

* * * * *

UNITED STATES PATENT AND TRADEMARK OFFICE

CERTIFICATE OF CORRECTION

PATENT NO. : 4,486,294

DATED : December 4, 1984

INVENTOR(S) : Jan D. Miller et al.

It is certified that error appears in the above—identified patent and that said Letters Patent is hereby corrected as shown below:

Column 6, line 23, "8 percent" should be --80 percent--
Column 6, line 27, "hotwater" should be --hot-water--
Column 7, line 56, "for" should be --from--
Column 7, line 62, ",he" should be --the--

Signed and Sealed this

*Eleventh* Day of *June 1985*

[SEAL]

*Attest:*

DONALD J. QUIGG

*Attesting Officer* *Acting Commissioner of Patents and Trademarks*